US007361841B1

(12) United States Patent
Smolen et al.

(10) Patent No.: US 7,361,841 B1
(45) Date of Patent: Apr. 22, 2008

(54) TERMINAL COVER WITH HINGE

(75) Inventors: Eric Scott Smolen, Redford Township, MI (US); Takeshi Takahashi, Novi, MI (US)

(73) Assignee: Yazaki North America, Inc., Canton, MI (US)

( * ) Notice: Subject to any disclaimer, the term of this patent is extended or adjusted under 35 U.S.C. 154(b) by 531 days.

(21) Appl. No.: 11/159,716

(22) Filed: Jun. 23, 2005

(51) Int. Cl.
*H01B 17/00* (2006.01)

(52) U.S. Cl. ..... 174/138 F; 174/135; 174/188; 439/536; 439/521; 429/65

(58) Field of Classification Search ..... 174/50, 174/53, 57, 58, 66, 67, 135, 138 F, 137 R, 174/188; 439/535, 536, 522, 904, 763, 521, 439/202, 76.1, 76.2; 429/65; 220/3.2, 3.3, 220/3.8, 4.02, 241, 242
See application file for complete search history.

(56) References Cited

U.S. PATENT DOCUMENTS 4,415,044 A * 11/1983 Davis ..... 174/138 F
5,439,759 A * 8/1995 Lippert et al. ..... 174/138 F
5,576,516 A * 11/1996 Kameyama et al. ..... 174/138 F
5,645,448 A * 7/1997 Hill ..... 439/522
5,804,770 A * 9/1998 Tanaka ..... 174/138 F
6,426,465 B1 * 7/2002 Kosuge ..... 174/138 F
6,533,619 B2 * 3/2003 Wakata et al. ..... 439/521
6,576,838 B2 * 6/2003 Matsumura ..... 174/138 F
6,679,708 B1 * 1/2004 Depp et al. ..... 439/76.2

* cited by examiner

*Primary Examiner*—Angel R. Estrada
(74) *Attorney, Agent, or Firm*—Young Basile

(57) ABSTRACT

A bussed electrical center (BEC) has a lateral appendage for a positive battery terminal to be used for jump starting purposes. A cover for the terminal is hingedly attached to the lateral appendage of the BEC by way of a relatively rotatable axle and bearing combination as well as facially abutting complemental locking surfaces each having alternatively raised and unraised sectors which interfit in each of two locking positions 180 degrees apart so that the cover can be locked fully open or fully closed.

7 Claims, 5 Drawing Sheets

TERMINAL COVER WITH HINGE

FIELD OF THE INVENTION

This invention pertains to mounting structures for electrical terminal elements and the like and more particularly to a hinged cover for the terminal element which can be rotated between open and closed positions and essentially locked in at least the open position.

BACKGROUND OF THE INVENTION

It is common to use box-like plastic structures for automotive electrical systems and to provide covers for such structure whereby various internal components can be protected from the elements yet remain easily accessed by opening the cover. Some covers merely snap in place and are easily separated from the box they are intended to cover. Other covers are hinged and can be "locked" only in the closed condition. In this text, the terms "locking" and "locked" are used to denote a relationship between two components which is stable and resists movement in at least one relative orientation, but which permits movement to another orientation when sufficient reorienting force is applied; i.e., it does not refer to a relationship between components requiring keys or combinations to permit relative movement.

SUMMARY OF THE INVENTION

The present invention provides a hinge performing a locking function in accordance with the definition given immediately above, which hinge can be advantageously used in and/or with covered structures for electrical terminals and the like. The present invention can be used to provide covers which are angularly moveable between open and closed positions wherein the hinge provides a locking function in at least the open condition without requiring additional parts or components and without requiring expensive hand assembly operations. In general, the hinge comprises a stator structure, typically integral with a larger component such as a terminal mounting structure, wherein the stator structure defines two oppositely facing, coaxial, lock-forming surfaces each with axially raised and non-raised sectors formed therein. The hinge further comprises a rotor structure, typically integral with the cover, including two oppositely facing, coaxial lock forming surfaces, each with alternating axially raised and non-raised sectors formed thereon. A bearing structure such as an axle and semicircular, outer bearing race are provided for resiliently mounting the stator and rotor structures such that the surfaces with the sectors formed thereon are in a facially abutting relationship, whereby relative rotation of the stator and rotor structures causes the sectors to assume a complemental locking relationship wherein the raised sector of one set of surfaces lies between the raised sectors of the other surfaces in at least one relative angular position.

In the illustrative embodiment more fully described in the following specification, the stator structure is formed on a molded plastic container and the lock forming surfaces are oppositely outwardly facing. The rotor structure is formed integrally with a terminal cover and the lock forming surfaces are oppositely inwardly facing. The raised and non-raised sectors are preferably joined by angled surfaces so as to facilitate relative rotation of the stator and rotor structures out of the "locked" position wherein the raised sectors of each of the pairs of surfaces bear against the raised sectors of the other pair of surfaces. Continued rotation brings the sectors back into a complemental or interfitting relationship. In this manner a "locking" relationship can be achieved in each of two relative angular positions of the cover relative to the mounting structure, these two positions corresponding to full open and full closed positions.

DETAILED DESCRIPTION OF THE ILLUSTRATIVE EMBODIMENT

Figure 1:
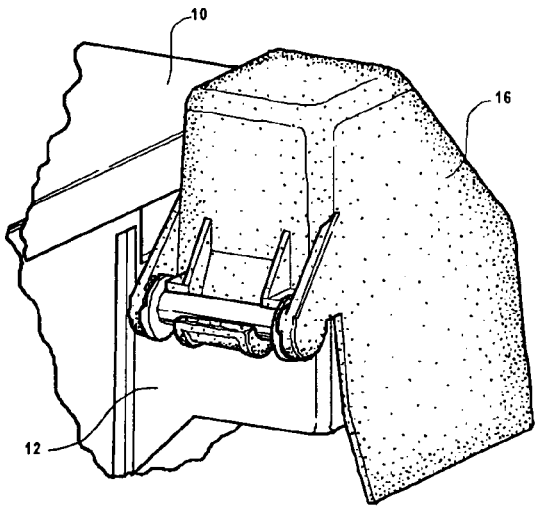
FIG. 1 is a perspective view of the invention as applied to a hinged cover for a battery terminal holder on an automotive fuse box, showing the holder in the closed position.
Figure 2:
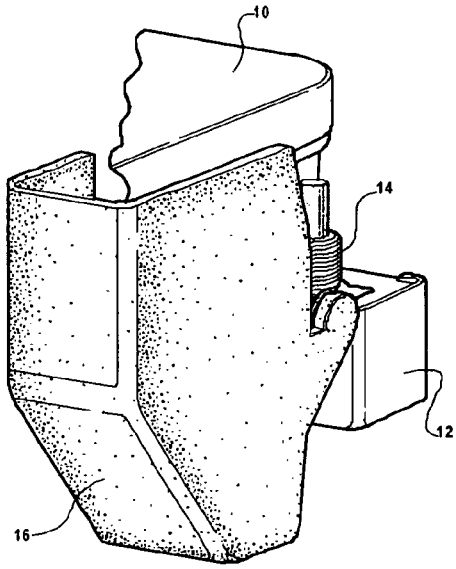
FIG. 2 is a perspective view of the structure of FIG. 1 with the holder in an open position.
Figure 3:
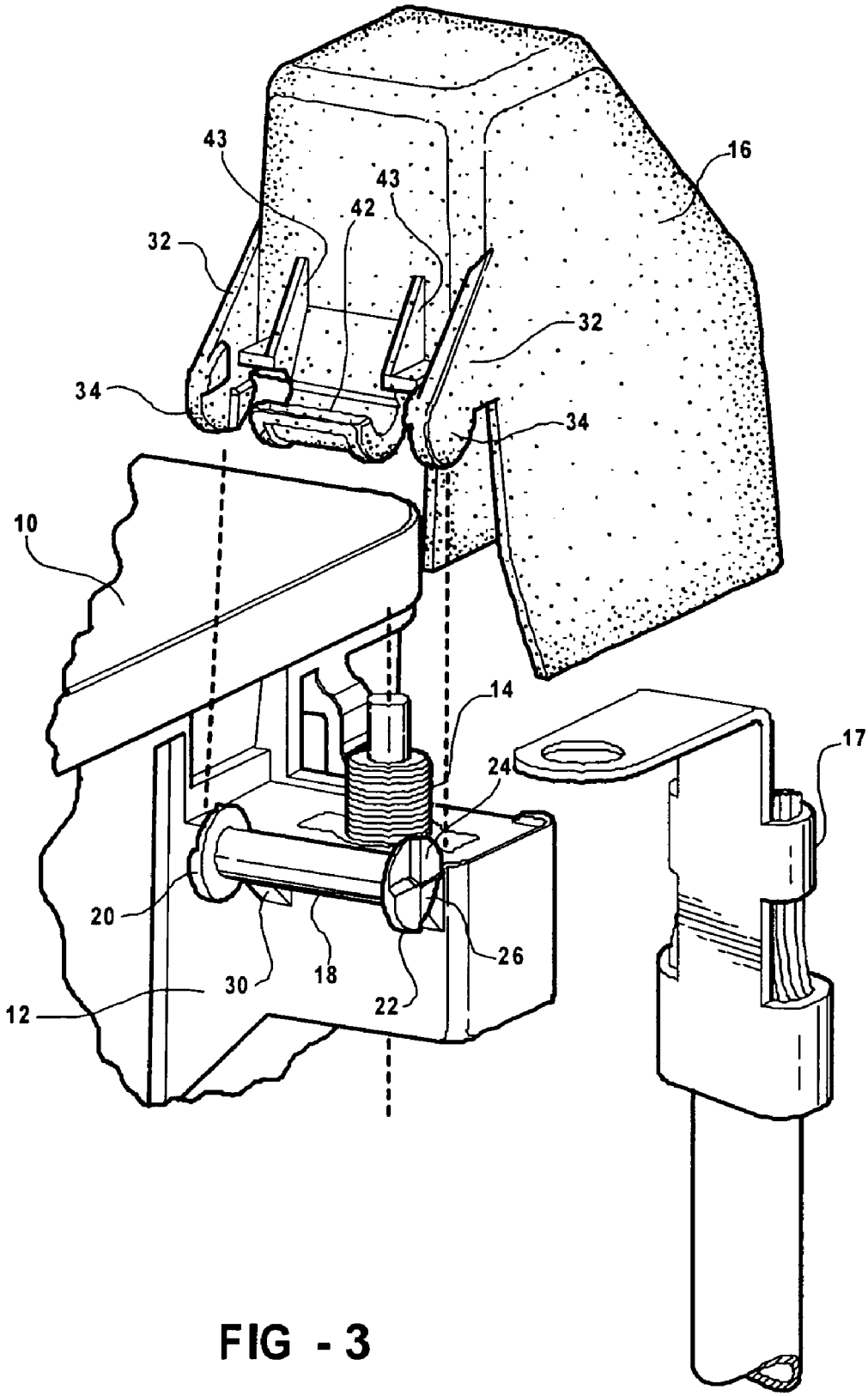
FIG. 3 is an exploded view of the structure of FIGS. 1 and 2, also in perspective.
Figure 4:
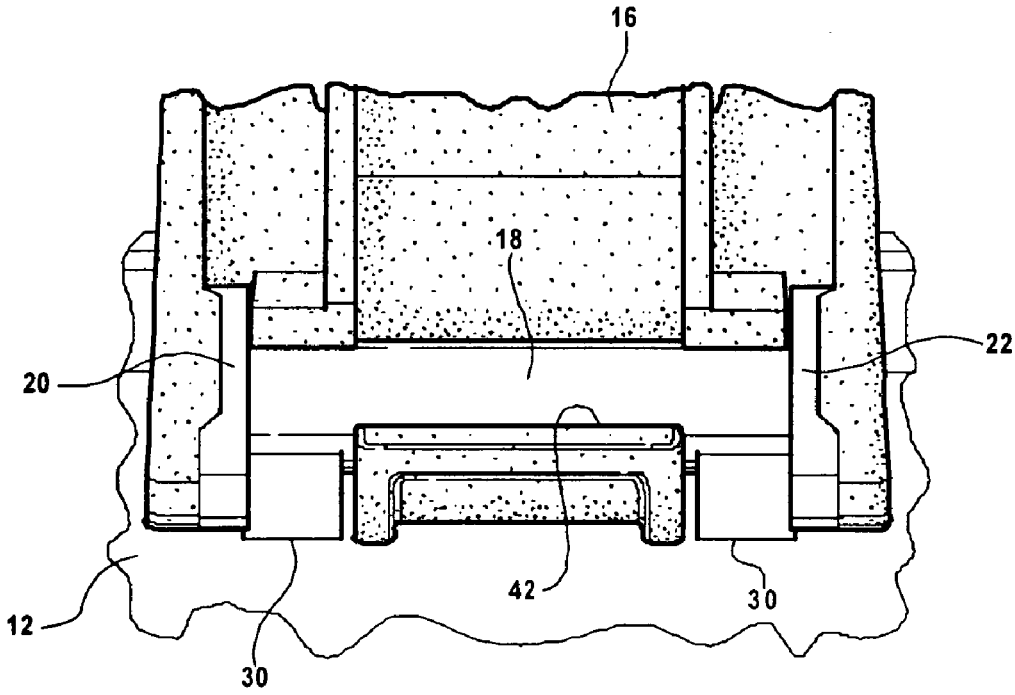
FIG. 4 is a back view of the cover illustrating the detail of the hinge structure in the combination of FIGS. 1-3.
Figure 5:
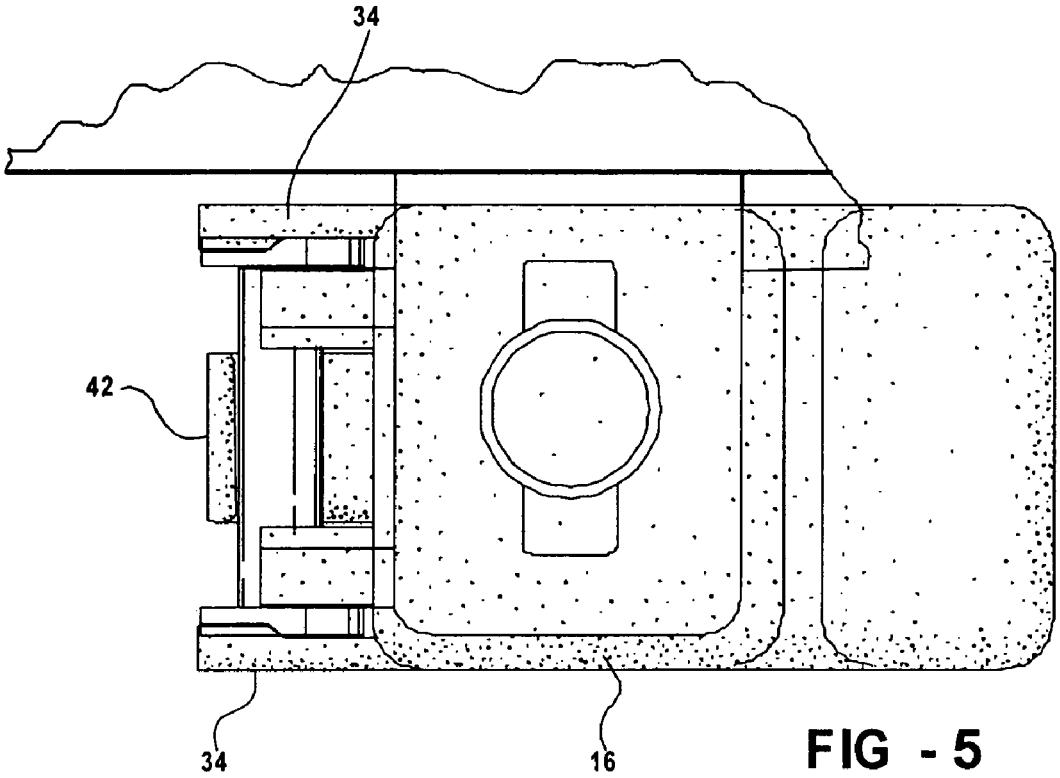
FIG. 5 is a top view of a detail of the structure of FIGS. 1-4.

Referring to the drawings, there is shown a molded plastic bussed electrical center (BEC) 10 having a lateral appendage 12 in the form of a box for a positive metal battery terminal 17. A molded plastic cover 16 is mounted on the lateral appendage box 12 for angular rotation between a closed position shown in FIG. 1 and a fully opened position as shown in FIG. 2. In normal production, the cover 16 is attached to the BEC 10 and left in the open position as shown in FIG. 2 in preparation for the installation of the battery terminal 17. The terminal 17 is placed over a threaded post 14 in the box 12. The post 14 is electrically connected to the BEC 10 through a bus bar. The terminal 17 is secured to the post 14 by a nut. Thereafter, the cover 12 may be rotated to the closed position shown in FIG. 1 to protect the terminal 17 from the elements and also to prevent inadvertent contact with the positive battery terminal when operatively installed in an automotive vehicle.

Figure 8:
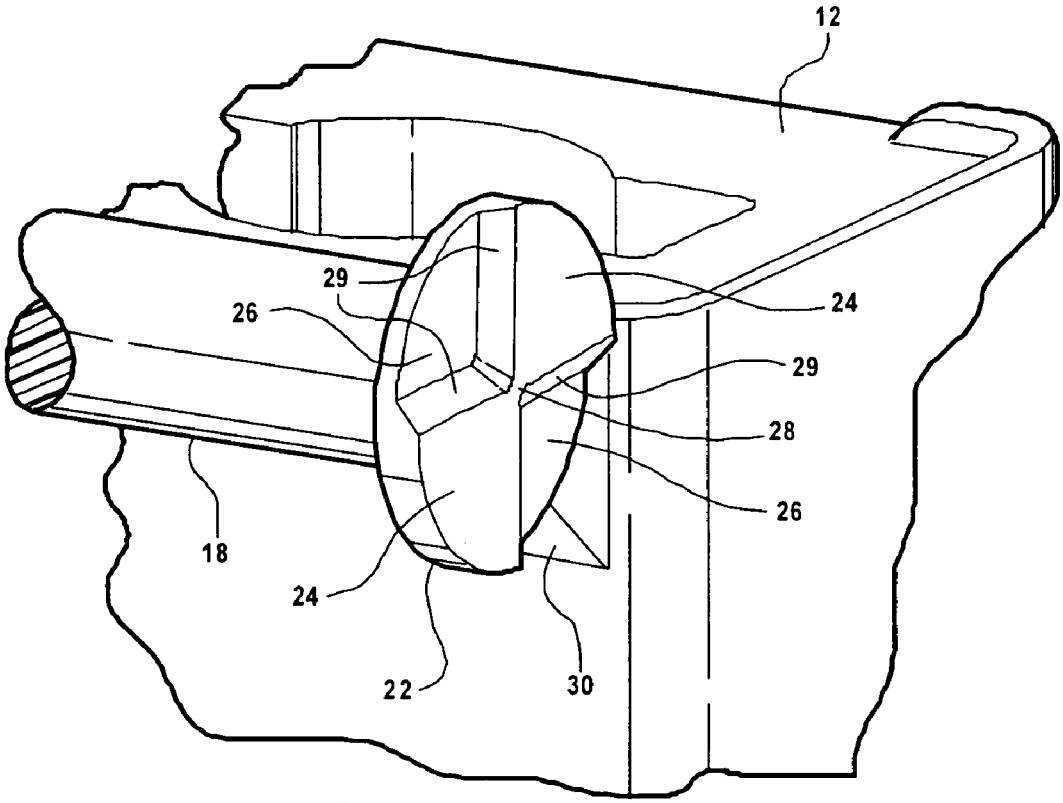
FIG. 8 is a perspective view of a hinge detail on the stator structure of the device of FIG. 1.

In accordance with the present invention, the appendage 12 is formed integrally with a stator hinge structure comprising a cylindrical axle 18 terminating in integral discs 20 and 22 at the opposite ends thereof. Each of the discs 20 and 22 has oppositely outwardly facing lock forming surfaces including two axially raised sectors 24 and, between the raised sectors 24, two unraised sectors 26. Each of the sectors takes up approximately 90 degrees of angular area and, as best shown in FIG. 8, the center points of the sectors 24 meet at a junction 28. Transition surfaces 29 are formed between the raised and unraised sectors 24 and 26 at an angle of, for example, approximately 45 degrees relative to the axis of rotation of the integral axle 18. The angle can be changed to adjust the force needed to rotate the cover. Struts 30 extend outwardly from a surface of the lateral appendage 12 to support the axle 18 and the discs 20 and 22.

Figure 9:
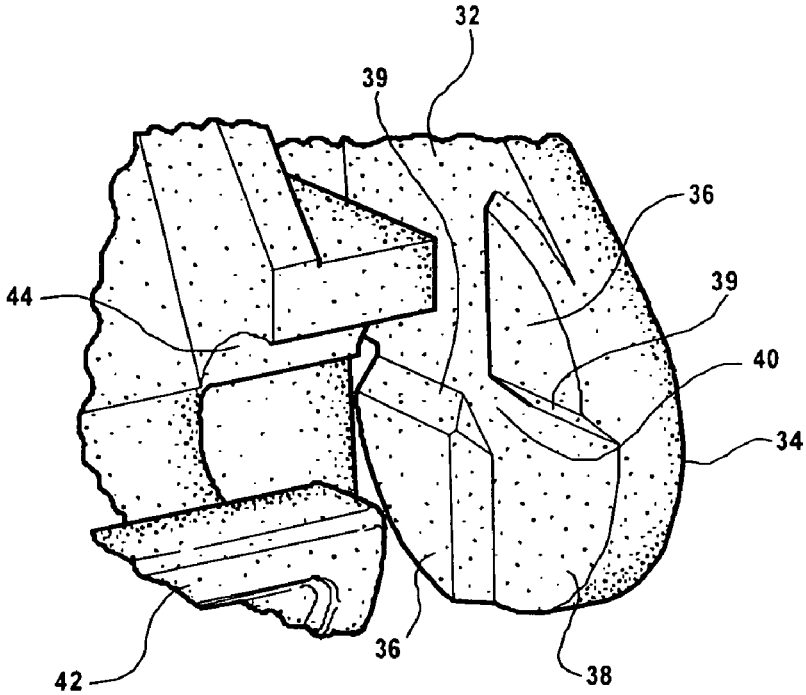
FIG. 9 is perspective view of a hinge surface in the rotor or cover structure of the device of FIG. 1.

A rotor structure is formed integrally with the cover 16 and comprises a pair of parallel arms 32 terminating in disc-like portions 34 having oppositely inwardly facing lock forming surfaces characterized by axially raised sectors 36 and complemental unraised sectors 38. As best shown in FIG. 9, the center points of the sectors 36 do not touch, but are separated by a gap 40. The gap 40 can be used to control the amount of force required to rotate the cover 16. If a larger force is desired, the gap could be eliminated. Again, 45 degree transition surfaces 39 are formed between the lock-forming surfaces of the sectors 36 and 38 for purposes to be described.

Figure 6:
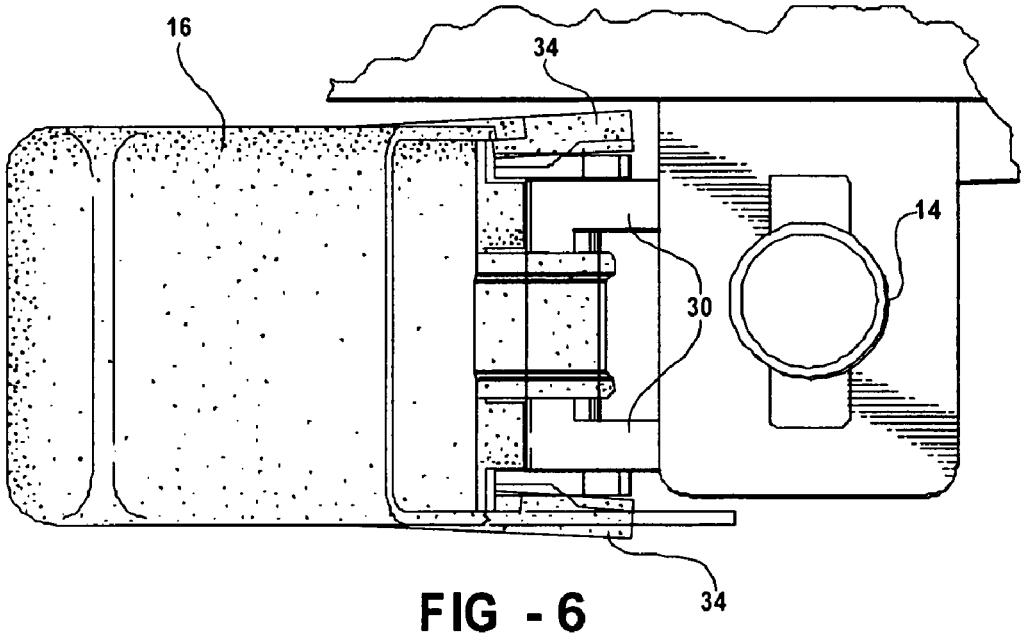
FIG. 6 is another detail of the terminal holder with the cover in the partially open position.
Figure 7:
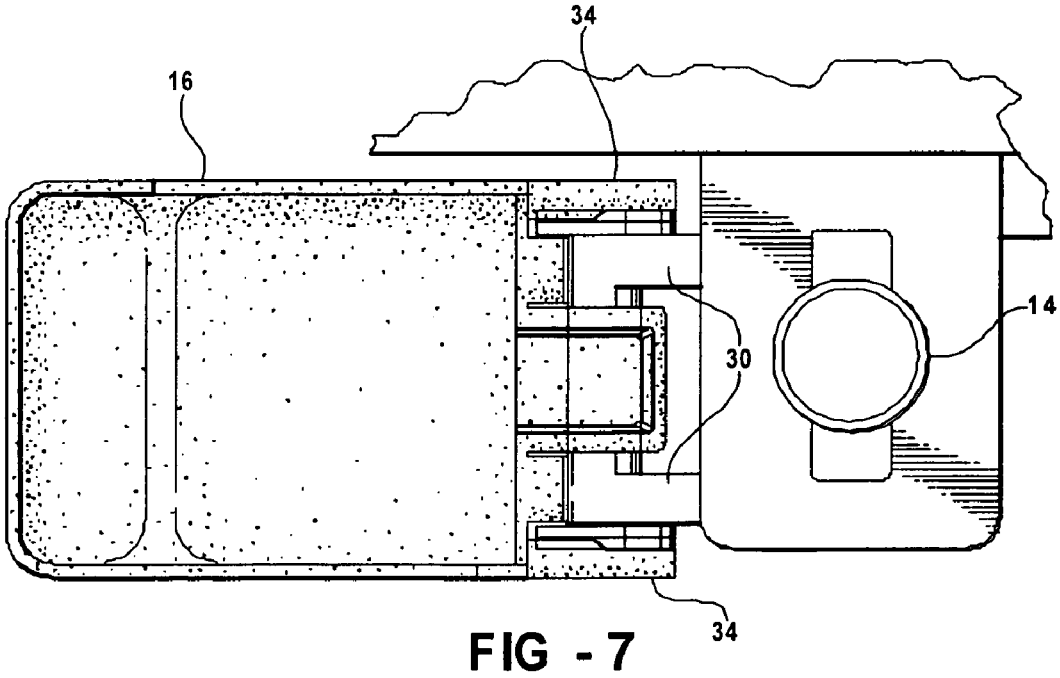
FIG. 7 is a bottom view of the structure of FIG. 6.

The rotor structure further comprises a semi-cylindrical outer bearing 42 integrally attached to the cover 16 by struts 43. The inner surface of the bearing structure 42 snaps around the axle 18 in the process of attaching the cover 16 to the appendage 12. The struts 43 also include bearing surfaces 44 to help retain the axle 18 in the outer bearing 42. This operation requires flexing the integral plastic arms 32 outwardly and maneuvering the cover 16 into a position wherein the raised sectors 24 of the stator fit into the unraised sectors 38 of the rotor. This is a so-called "locked" position wherein the cover 16 will remain in that position until sufficient force is applied to cause the raised sectors 36 to ride up and over the transition surfaces 29 and until the raised sectors 24 and 36 are in facially abutting relationship. One may continue to rotate the hinge, rotational stability being provided by the axle 18 and the bearing 42, until the raised sectors 36 drop into the unraised sectors 26 after 180 degrees of angular rotation. The two "locked" conditions preferably correspond with the full open condition shown in FIG. 2 and the fully closed condition shown in FIG. 1. Again, the arms 32 flex outwardly as shown in FIG. 6 not only during installation, but in the unlocked or intermediate condition of the cover 16 relative to the appendage 12, the plastic material of construction inherently providing sufficient resilience to permit such flexing.

In a practical embodiment the BEC 10 and cover 16 are made of polypropylene, the fuse box 10 and appendage 12 being approximately 35% talc filled for high rigidity while the polypropylene cover is only approximately 10% talc filled to provide additional resilience in order to facilitate the spring function of the arms 32 supporting the rotor discs 34. These materials are, of course, given by way of example. The gap 40 decreases the force required to operate the hinge and relaxes tooling tolerances as well. In addition, as an alternative, the stator structure could be formed on the cover and the rotor structure could be formed on the appendage box.

While it is to be understood that the embodiment disclosed herein where the locking surfaces on the stator discs are outwardly facing and the locking surfaces on the rotor discs are inwardly facing, it is possible to construct an operative unit using the inverse of this design. Various other additions and modifications to the invention may be made by persons skilled in the art.

What is claimed is:

1. A hinge lock comprising:

a stator structure including two oppositely facing, coaxial lock forming surfaces, each surface having alternating axially raised and non-raised sectors formed thereon;

a rotor structure including two oppositely facing coaxial lock forming surfaces, each surface having alternating axially raised and non-raised sectors which are complemental to the sectors of said rotor structure; and a bearing structure for resiliently mounting the stator and rotor structures such that the sectors are in facially abutting relationship whereby rotation of the rotor relative to the stator causes the sectors to assume a complemental locking relationship in at least one angular position.

2. The hinge lock defined in claim 1, wherein the stator surfaces are oppositely outwardly facing and the rotor surfaces are oppositely inwardly facing.

3. The hinge lock defined in claim 2, wherein the bearing structure comprises an axle shaft extending between and joined to the stator surfaces, and the rotor structure includes a semi-cylindrical hinge disposed between the space from the rotor surfaces and bearing against said axle shaft.

4. The hinge lock defined in claim 1, wherein the sectors of the stator structure are essentially joined at the center points thereof.

5. A hinge lock defined in claim 1, wherein the sectors of the rotor structure define a gap between the center points thereof.

6. A rigid container for an electrical terminal element and a cover member mounted on the rigid container for rotation between at least one open position and a closed position;

a hinge lock comprising two oppositely outwardly facing coaxial surfaces formed on said rigid container, each surface having alternately axially raised and non-raised sectors formed thereon;

a rotor structure integral with said cover including two oppositely inwardly facing coaxial surfaces, each surface having alternating axially raised and non-raised sectors formed thereon;

the sectors of said rigid container being complemental to the sectors of said cover; and a bearing structure for mounting the cover on the container such that the complemental lock forming surfaces are in facially abutting relationship whereby relative rotation of the cover and the container causes the sectors to assume a complemental locking relationship in at least one open position.

7. The structure defined in claim 6, wherein the bearing structure comprises an axle shaft extending between and joined to the coaxial surfaces of the cover and a semi-cylindrical hinge disposed between the space from the oppositely facing lock forming structures of the cover and bearing against the axle shaft.

* * * * *